US005558450A

United States Patent [19]

Tsuboi et al.

[11] Patent Number: 5,558,450

[45] Date of Patent: Sep. 24, 1996

[54] INK RIBBON FABRIC FOUNDATION

[75] Inventors: Seiji Tsuboi; Zheng l. Cai, both of Osaka, Japan

[73] Assignee: Fujicopian Co., Ltd., Osaka, Japan

[21] Appl. No.: 418,070

[22] Filed: Apr. 6, 1995

[30] Foreign Application Priority Data

Apr. 7, 1994 [JP] Japan ..... 6-069660

[51] Int. Cl.[6] ..... B41J 31/02

[52] U.S. Cl. ..... 400/241.3; 139/383 R; 428/224

[58] Field of Search ..... 400/241, 241.3; 139/383 R, 384 R, 426 R; 428/175, 224, 229, 252, 257

[56] References Cited

U.S. PATENT DOCUMENTS

| | | | |
|---|---|---|---|
| 4,874,263 | 10/1989 | McCall et al. | 400/241.3 |
| 5,275,858 | 1/1994 | Hock | 428/58 |

FOREIGN PATENT DOCUMENTS

| | | | |
|---|---|---|---|
| 098382 | 6/1982 | Japan | 400/241.3 |
| 031179 | 2/1984 | Japan | 400/241.3 |
| 127789 | 7/1984 | Japan | 400/241.3 |
| 284476 | 12/1986 | Japan | 400/241.3 |
| 237183 | 9/1989 | Japan | 400/241.3 |
| 019882 | 1/1991 | Japan | 400/241.3 |
| 2245525 | 1/1992 | United Kingdom | B32B 5/08 |

OTHER PUBLICATIONS

*Derwent Database Abstract,* No. 88–252 901, citing Japanese patent application 63–182443, published Jul. 27, 1988.

*Patent Abstracts of Japan,* vol. 6, No. 190 (M–159), published Sep. 29, 1982, citing Japanese patent application 57–98382, published Jun. 18, 1982.

*Patent Abstracts of Japan,* vol. 17, No. 11 (C–1015), published Jan. 8, 1993, citing Japanese patent application 4–241132, published Aug. 28, 1992.

*Primary Examiner*—Ren Yan

*Attorney, Agent, or Firm*—Fish & Neave

[57] ABSTRACT

A fabric foundation for an ink ribbon comprising a woven fabric comprising warp yarns and weft yarns, and the woven fabric satisfying the following equation:

$$K=1.5 \text{ to } 6$$

wherein K is the ratio of $C_1/C_2$; $C_1$ is a warp crimp rate; and $C_2$ is a weft crimp rate. The ink ribbon fabric foundation is hardly damaged under severe printing conditions such as high speed and strong striking force, offering an extended life.

3 Claims, 3 Drawing Sheets

(PRIOR ART)

INK RIBBON FABRIC FOUNDATION

BACKGROUND OF THE INVENTION

The present invention relates to a fabric foundation for an ink ribbon which is used for printing while being impregnated with a liquid ink.

Ink ribbons impregnated with a liquid ink have been used in various impact printers such as wire dot printers and daisy wheel printers.

The recent trend in such printers is toward higher printing speed. With these printers, printing is conducted while running an ink ribbon and, hence, a monentary rubbing between the ink ribbon and a printing paper, which is caused when striking with a print head, becomes violent with an increased printing speed.

Further, the number of constituent sheets of duplicate chits or slips, and the like has been increased and increasingly, printing is conducted on such thick paper sheets as used in deposit passbooks, and the like.

These cases require that a stronger striking power be exerted on the ink ribbon.

Owing to such increased rubbing and striking forces, ink ribbons are used under extremely severe conditions, resulting in damage to the ink ribbons in a short period of time.

This tendency is of particular concern with seamless ink ribbons because it is difficult to produce these ribbons having a large entire length.

The seamless ink ribbon is fabricated by weaving a tubular fabric as shown in FIG. 3(A) according to an endless plain weaving method and cutting crosswise the tubular fabric to a desired width, yielding ring-like fabric foundations with no seam for the seamless ink ribbon as shown in FIG. 3(B). In FIG. 3(A), the vertical direction of the tube corresponds to the warp yarn direction, and the circumferential direction of the tube corresponds to the weft yarn direction. FIG. 3(C) is an enlarged partial plan view showing the thus obtained seamless ink ribbon fabric foundation, wherein numeral 1 denotes a warp yarn and numeral 2 denotes a weft yarn.

In view of the foregoing, it is an object of the present invention to provide a fabric foundation for an ink ribbon, particularly for a seamless ink ribbon, which is hardly damaged under severe printing conditions such as high speed and strong striking force, offering an extended life.

This and other objects of the present invention will become apparent from the description hereinafter.

SUMMARY OF THE INVENTION

The present invention provides a fabric foundation for an ink ribbon comprising a woven fabric comprising warp yarns and weft yarns, and the woven fabric satisfying the following equation:

$$K=1.5 \text{ to } 6$$

wherein K is the ratio of $C_1/C_2$; $C_1$ is a warp crimp rate; and $C_2$ is a weft crimp rate.

Herein, the terms "warp yarn" and "weft yarn" mean the warp yarn and the weft yarn on a loom, respectively. Accordingly, with the seamless ink ribbon, yarns in the vertical direction of the ribbon are warp yarns and yarns in the circumferential direction of the ribbon are weft yarns.

The warp crimp rate $C_1$ is defined by the following formula:

$$\text{Warp crimp rate } C_1\,(\%) = \frac{L_{10} - L_1}{L_1} \times 100$$

wherein $L_1$ is a given length of the ink ribbon fabric foundation in the warp yarn direction, and $L_{10}$ is the length of the warp yarns constituting the fabric foundation of the given length.

The weft crimp rate $C_2$ is defined by the following formula:

$$\text{Weft crimp rate } C_2\,(\%) = \frac{L_{20} - L_2}{L_2} \times 100$$

wherein $L_2$ is a given length of the ink ribbon fabric foundation in the weft yarn direction, and $L_{20}$ is the length of the weft yarns constituting the fabric foundation of the given length.

The present inventors have examined conventional seamless ink ribbon fabric foundations and found that with the conventional seamless ink ribbon fabric foundations, the ratio K of the warp crimp rate $C_1$ to the weft crimp rate $C_2$ ($K=C_1/C_2$) (hereinafter, the ratio K is referred to as "crimp rate ratio") usually ranges from 8 to 9.

Figure 4:
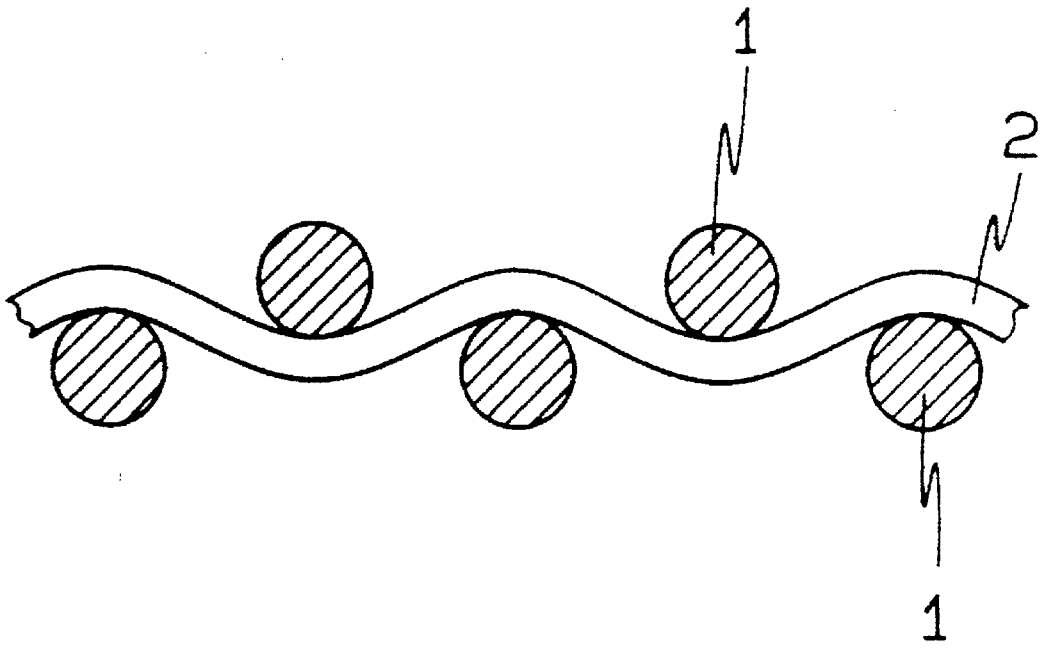
FIG. 4 is a schematic sectional view showing a conventional ink ribbon fabric foundation.

A microscopic observation of the conventional seamless ink ribbon fabric foundations reveals that the warp yarn 1 is a little slackened and the weft yarn 2 is a little tightened, as shown in FIG. 4.

Further, it has been found that when printing is conducted with use of an ink ribbon in such a condition, on the printing paper side, the warp yarns of the fabric foundation mainly strike the printing paper when striking with a printing head, resulting in deterioration of the warp yarns due to the rubbing and impact, and on the printing head side, the warp yarns are also deteriorated by direct striking while the thermal head, so that the fabric foundation is damaged in a short period of time.

The present inventors have done intensive researche on the basis of these findings and succeeded in fabricating a fabric foundation having an extended life by specifying the crimp rate ratio K to the range of from 1.5 to 6. When the crimp rate ratio of the fabric foundation is within the range of from 1.5 to 6, the warp yarns and the weft yarns strike the printing paper to the same degree, resulting in an extremely extended life.

The present invention will be explained by taking a fabric foundation for a seamless ink ribbon as an example.

Figure 1:
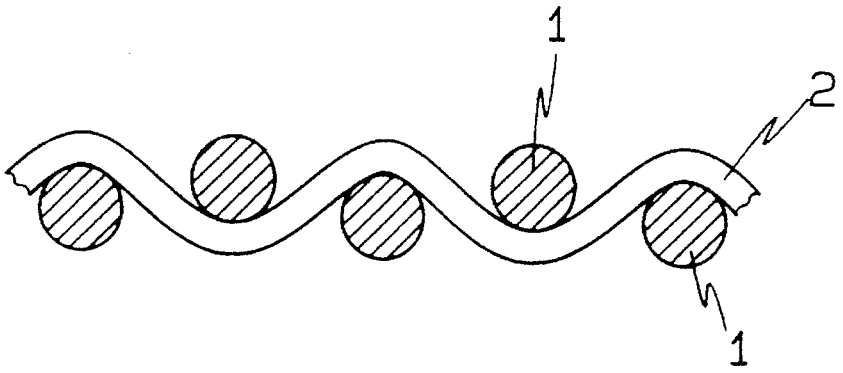
FIG. 1 is a schematic sectional view showing an example of the ink ribbon fabric foundation of the present invention.

FIG. 1 is a schematic sectional view showing an example of a fabric foundation for a seamless ink ribbon according to the present invention.

As illustrated in FIG. 1, with the fabric foundation satisfying the crimp rate ratio prescribed in the present invention, the warp yarns 1 are tightened as compared to the warp yarns of the conventional fabric foundation and the weft yarns 2 are slackened as compared to the weft yarns of the conventional fabric foundation, and, hence, the warp yarns 1 and the weft yarns 2 appear to the same degree on the surface of the fabric foundation. When printing is conducted with the use of an ink ribbon using such a fabric foundation, the warp yarns 1 and the weft yarns 2 strike a printing paper to the same degree when striking with the printing head. Thus, deterioration of only the warp yarns, as occurs with the conventional ink ribbon is prevented to provide a largely extended life.

For example, as shown in comparative tests mentioned below, the life (expressed in terms of the number of characters printed until the ink ribbon is damaged) of a conventional fabric foundation having a crimp rate ratio K of 8.7 is 90×104 characters, while the life of a fabric foundation having a crimp rate ratio of 6 according to the present invention is $150\times10^4$ characters which is 1.7 times the value $90\times10^4$ characters. Thus, a large extension of the life of a seamless ink ribbon can be achieved by the present invention.

When the crimp rate ratio K is larger than 6, the warp yarns 1 become a little slackened and, hence, the degree to which the warp yarns 1 strike the printing paper when striking with the printing head is greater than that to which the weft yarns 2 strike the printing paper. Consequently, the warp yarns 1 are violently deteriorated, resulting in reduction of life of the fabric foundation. When the crimp rate ratio K is smaller than 1.5, conversely the weft yarns 2 become a little slackened, and, hence, the weft yarns 2 mainly strike the printing paper when striking with the printing head, resulting in reduction of life of the fabric foundation. Further, stable production of a fabric foundation having a crimp rate ratio of smaller than 1.5 is difficult under the present condition.

Usable as the warp yarn or the weft yarn in the present invention are yarns obtained from one or more of synthetic fibers, regenerated fibers and natural fibers, inclusive of polyamide fibers such as nylon 6 and nylon 66, polyester fibers, rayon fiber, silk fiber and cotton fiber. Yarns of about 20 to about 70 deniers each are preferably used. Usually, the yarns used are obtained by gathering a plurality of single fibers (monofilaments) each of about 0.8 to about 3 deniers or a plurality of spun yarns (of natural fiber such as silk fiber or cottoh fiber) each of about 0.8 to about 3 deniers, and preferably subjecting the resultant to a soft twist to give yarns each having a thickness within the above-mentioned range.

With use of the aforesaid warp yarns and weft yarns, a tubular fabric is preferably woven by an endless plain weaving method.

Figure 2:
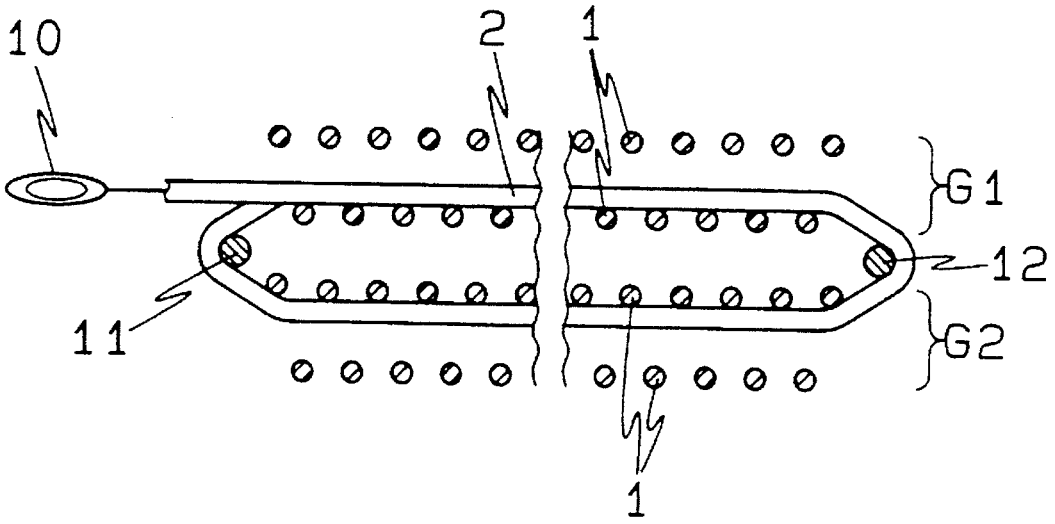
FIG. 2 is a schematic sectional view illustrating an example of an endless plain weaving method.
Figure 3A:
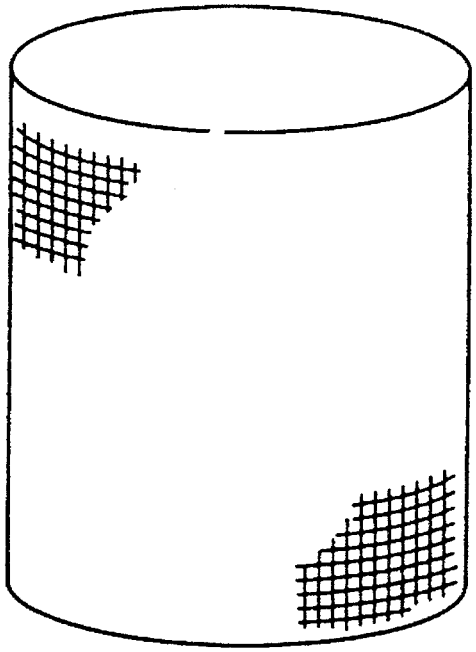
FIG. 3(A) is a perspective view showing a tubular fabric woven by an endless plain weaving method.
Figure 3B:
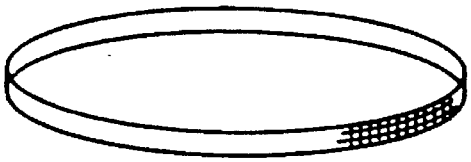
FIG. 3(B) is a perspective view showing a fabric foundation for a seamless ink ribbon obtained by cutting crosswise the tubular fabric.
Figure 3C:
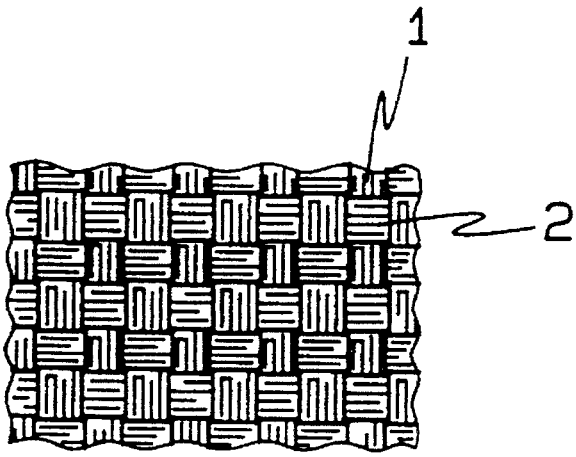
FIG. 3(C) is an enlarged partial plan view showing the tissue of the seamless ink ribbon fabric foundation obtained by the endless plain weaving method.

FIG. 2 is a schematic sectional view showing an example of the endless plain weaving method. As shown in FIG. 2, a weft yarn 2 is moved to and fro through group $G_1$ of warp yarns and group $G_2$ of warp yarns arranged above and below in two rows to weave a tubular fabric. In FIG. 2, numeral 10 denotes a shuttle, and numerals 11 and 12 denote pins for supporting the ends of the weft yarn 2 between which the weft yarn 2 is moved to and fro.

The crimp rate ratio of the resulting fabric can be controlled by adjusting the tensile force exerted on the warp yarn 1 and the tensile force exerted on the weft yarn 2 to adjust the warp crimp rate $C_1$ and the weft crimp rate $C_2$.

In view of ensuring general requirements for ink ribbon fabric foundations, such as strength, capacity for containing ink and clearness of print images, it is preferable to adjust the crimp rate ratio K to the range of 1.5 to 6, provided that the following conditions are satisfied:

Warp yarn density=120 to 190 yarns/inch,

Weft yarn density=120 to 170 yarns/inch,

Warp crimp rate $C_1$=7 to 15%, and

Weft crimp rate $C_2$=1 to 6%.

The thus obtained tubular fabric is cut crosswise to a desired length into rings, which are subjected to post-treatments such as washing and scouring to give the desired fabric foundations for a seamless ink ribbon. The fabric foundation is impregnated with a liquid ink composition to give a seamless ink ribbon.

In the foregoing, the present invention has been explained by taking the fabric foundation for the seamless ink ribbon as an example. However, the present invention is also preferably applicable to a fabric foundation for an endless ink ribbon with a seam, which is obtained by cutting off a strap from a plain weave fabric and joining both ends of the strap. With the endless ink ribbon fabric foundation, usually, the vertical direction of the ribbon corresponds to the warp yarn direction, and the circumterntial direction of the ribbon corresponds to the weft yarn direction.

The present invention will be more fully described by way of Examples. It is to be understood that the present invention is not limited to the Examples, and various change and modifications may be made in the invention without departing from the spirit and scope thereof.

EXAMPLES 1 TO 4 AND COMPARATIVE EXAMPLES 1 TO 2

A yarn of 40 deniers which was obtained by gathering 34 nylon 66 monofilaments each of 1.2 deniers and subjecting the resultant to a soft twist, was used as a warp yarn, and a yarn of 40 deniers which was obtained by gathering 34 nylon 66 monofilaments each of 1.2 deniers and subjecting the resultant to a soft twist, was used as a weft yarn. The warp yarn and the weft yarn were woven with adjusting the tensile forces of the warp yarn and weft yarn according to the endless plain weaving method as shown in FIG. 2 to give a tubular fabric with a circumferential length of 1.6 m having yarn density, crimp rate and crimp rate ratio as shown in Table 1.

The tubular fabric was cut crosswise to a width of 8 mm into rings, which were subjected to scouring treatment to give fabric foundations for a seamless ink ribbon.

The fabric foundation was impregnated with a liquid ink having the following formula to give a seamless ink ribbon.

Ink formula

| Component | Parts by weight |
|---|---|
| Nigrosine Base | 20 |
| Carbon black | 5 |
| Oleic acid | 30 |
| Sorbitan | 20 |
| Motor oil | 25 |

With use of each of the thus obtained seamless ink ribbons on a wire dot printer equipped with a printing head having 24 pins, LQ (letter quality) printing was conducted on a paper for business form 55 kg made by Toppan Moore Co., Ltd. to determine the life ( the number of characters printed till the ink ribbon is damaged) of the ink ribbon fabric foundation. The results are shown in Table 1.

TABLE I

| | Crimp rate ratio (K) | Yarn density (yarns/inch) | | Crimp rate (%) | | Life (Number of characters) |
|---|---|---|---|---|---|---|
| | | Warp | Weft | Warp ($C_1$) | Weft ($C_2$) | |
| Com. Ex. 1 | 1.2 | 146 | 148 | 7.0 | 6.0 | $100 \times 10^4$ |
| Ex. 1 | 1.6 | 146 | 148 | 8.0 | 5.0 | $160 \times 10^4$ |
| Ex. 2 | 3.0 | 146 | 148 | 10.0 | 3.3 | $200 \times 10^4$ |
| Ex. 3 | 4.0 | 146 | 148 | 10.0 | 2.5 | $180 \times 10^4$ |
| Ex. 4 | 6.0 | 146 | 148 | 12.0 | 2.0 | $150 \times 10^4$ |
| Com. Ex. 2 | 8.7 | 146 | 148 | 13.0 | 1.5 | $90 \times 10^4$ |

In addition to the materials and ingredients used in the Examples, other materials and ingredients can be used in Examples as set forth in the specification to obtain substantially the same results.

As described above, the ink ribbon fabric foundation of the present invention wherein the ratio K of the warp crimp rate $C_1$ to the weft crimp rate $C_2$ is specified to the range of from 1.5 to 6 provides an extremely extended life for use with an impact printer wherein printing is performed at a high speed and a strong striking force.

What is claimed is:

1. An ink ribbon fabric foundation comprising a plain weave fabric comprising warp yarns and weft yarns, said plain weave fabric satisfying the following equation:

$$K=1.5 \text{ to } 6$$

wherein K is the ratio of $C_1/C_2$; $C_1$ is a warp crimp rate; and $C_2$ is a weft crimp rate.

2. The fabric foundation of claim 1, wherein the plain weave fabric is in the form of a seamless ring.

3. The fabric foundation of claim 1, wherein the plain weave fabric satisfies the following conditions:

Warp yarn density=120 to 190 yarns/inch,

Weft yarn density=120 to 170 yarns/inch,

Warp crimp rate $C_1$=7 to 15%, and

Weft crimp rate $C_2$=1 to 6%.

* * * * *

UNITED STATES PATENT AND TRADEMARK OFFICE

CERTIFICATE OF CORRECTION

PATENT NO : 5,558,450

DATED : September 24, 1996

INVENTION(S) : INK RIBBON FABRIC FOUNDATION

It is certified that error appears in the above-identified patent and that said Letters Patent are hereby corrected as shown below:

Cover Page, Item [75], delete "Zheng I. Cai" and substitute therefor -- Zheng L. Cai --.

Column 1, line 14 delete "monentary" and substitute therefor -- momentary --.

Column 2, line 54 delete "while" and substitute therefor -- with --.

Column 2, line 57 delete "researche" and substitute therefor -- research --.

Column 3, line 15 after ribbon insert a comma -- , -.

Column 3, line 21 delete "90 x 104" and substitute therefor -- 90 x $10^4$ --.

Column 3, line 50 delete "cottoh" and substitute therefor -- cotton --.

UNITED STATES PATENT AND TRADEMARK OFFICE

CERTIFICATE OF CORRECTION

PATENT NO. : 5,558,450

DATED : September 24, 1996

INVENTOR(S) : INK RIBBON FABRIC FOUNDATION

It is certified that error appears in the above-identified patent and that said Letters Patent is hereby corrected as shown below:

Column 4, line 27 delete "circumterntial" and substitute therefor -- circumferential --.

Column 4, line 31 delete "change" and substitute therefor -- changes --.

Signed and Sealed this

Twenty-fourth Day of October, 2000

*Attest:*

*Attesting Officer*

Q. TODD DICKINSON

*Director of Patents and Trademarks*